US010327551B1

(12) United States Patent
Johnson et al.

(10) Patent No.: US 10,327,551 B1
(45) Date of Patent: Jun. 25, 2019

(54) VERTICAL SHELF SUPPORT BARS HAVING LATERALLY SPACED APART FIRST SUPPORT INTERFACES AND SECOND SUPPORT INTERFACES RECESSED AND LATERALLY INSIDE THE FIRST SUPPORT INTERFACES

(71) Applicants: Sasha Johnson, Fullerton, CA (US); Linn Steinbeck, Broomfield, CO (US)

(72) Inventors: Sasha Johnson, Fullerton, CA (US); Linn Steinbeck, Broomfield, CO (US)

( * ) Notice: Subject to any disclaimer, the term of this patent is extended or adjusted under 35 U.S.C. 154(b) by 0 days.

(21) Appl. No.: 14/104,150

(22) Filed: Dec. 12, 2013

(51) Int. Cl.
*A47B 96/02* (2006.01)
*A47B 57/06* (2006.01)

(52) U.S. Cl.
CPC ..... *A47B 96/028* (2013.01); *A47B 57/06* (2013.01)

(58) Field of Classification Search
CPC ..... A47B 96/028; A47B 57/06
USPC .... 248/558, 220.31, 220.41, 221.12, 222.41, 248/243; 108/106–108, 110, 147.11, 108/147.12, 147.17, 152; 52/36.4, 36.5; 211/90.01, 90.02, 90.04, 87.01, 187, 153, 211/103, 106
See application file for complete search history.

(56) References Cited

U.S. PATENT DOCUMENTS 773,972 A * 11/1904 Palmenberg ..... 248/235
1,055,522 A * 3/1913 Cumming ..... 248/243
2,240,086 A * 4/1941 Adler ..... 108/152
2,783,961 A 3/1957 Weber
2,956,688 A * 10/1960 Galassi ..... 108/108
3,244,127 A * 4/1966 Evans ..... 108/108
3,247,809 A * 4/1966 Thomson ..... 108/6
3,265,217 A * 8/1966 Biggs ..... 211/90.02
3,353,507 A * 11/1967 Squires ..... 108/107
3,556,306 A * 1/1971 Shell ..... 211/90.02
3,638,981 A * 2/1972 Weider ..... F16B 7/00 211/192
3,640,389 A * 2/1972 Snyder ..... A47B 96/025 108/108
3,640,398 A 2/1972 Snyder
3,871,144 A * 3/1975 Rudin ..... 52/36.5
4,073,384 A 2/1978 Celeste
4,122,955 A * 10/1978 Celms ..... 211/133.5
4,250,815 A * 2/1981 Swanson ..... 108/108
4,531,698 A 7/1985 Sharber
4,646,656 A * 3/1987 Marschak ..... 108/108
5,072,839 A * 12/1991 Arnone ..... 211/187
5,199,585 A * 4/1993 Schafer ..... 211/187
5,433,327 A * 7/1995 Benvenuti et al. ..... 211/193
5,463,966 A * 11/1995 Nilsson ..... 108/110
(Continued)

*Primary Examiner* — Jonathan Liu
*Assistant Examiner* — Devin K Barnett
(74) *Attorney, Agent, or Firm* — The Law Office of Austin Bonderer, PC; Austin Bonderer

(57) ABSTRACT

A nested vertical shelf mount system includes vertical bars having a first set of vertically spaced apart mounting features and a second set of vertically spaced apart mounting features spaced inside and behind the first set of vertically spaced apart mounting features. The mounting features may be any feature allowing a shelf, panel, or the like, to be attached to the vertical bars. A panel may be attached to the second set of vertically spaced apart mounting features and a shelf may be attached to the first set of vertically spaced apart mounting features residing over the panel to provide a finished appearance.

7 Claims, 4 Drawing Sheets

(56) References Cited

U.S. PATENT DOCUMENTS 5,495,952 A * 3/1996 Kainz ..... 211/90.04
5,509,541 A * 4/1996 Merl ..... 211/103
5,673,801 A * 10/1997 Markson ..... 211/59.3
5,799,588 A * 9/1998 Engel ..... 108/108
5,918,432 A * 7/1999 Mahone et al. ..... 52/220.2
5,918,750 A * 7/1999 Jackson ..... 211/189
5,921,411 A * 7/1999 Merl ..... A47B 96/00 108/108
6,029,833 A * 2/2000 Yeh ..... 211/189
6,112,913 A * 9/2000 Rindoks et al. ..... 211/90.02
6,115,978 A * 9/2000 Bastian et al. ..... 52/243.1
6,164,467 A * 12/2000 DePottey et al. ..... 211/189
6,179,136 B1 * 1/2001 Kluge et al. ..... 211/90.01
6,203,234 B1 * 3/2001 Olson ..... 403/254
6,487,978 B1 * 12/2002 Hamberg ..... 108/108
6,681,941 B1 * 1/2004 Johnson ..... 211/86.01
6,698,604 B2 * 3/2004 Denny et al. ..... 211/189
6,918,499 B2 * 7/2005 De Land et al. ..... 211/187
7,240,803 B2 * 7/2007 Stitchick et al. ..... 211/106
7,261,214 B2 * 8/2007 Wagner et al. ..... 211/90.02
7,270,242 B2 * 9/2007 Liu ..... 211/189
7,481,406 B2 * 1/2009 Lang et al. ..... 248/220.31
7,669,945 B2 * 3/2010 Blersch et al. ..... 312/408
7,900,783 B2 * 3/2011 Fernandez et al. ..... 211/90.02
8,028,846 B2 * 10/2011 Peota et al. ..... 211/187
8,061,539 B2 * 11/2011 Punzel et al. ..... 211/103
8,234,983 B2 * 8/2012 Randolph ..... 108/108
8,235,224 B2 * 8/2012 Scholz ..... A47B 47/027 211/23
8,393,585 B2 * 3/2013 Han et al. ..... 248/158
8,646,624 B2 * 2/2014 Fernandez et al. ..... 211/90.02
8,672,150 B2 * 3/2014 Chen et al. ..... 211/187
9,226,577 B2 * 1/2016 Stepp ..... A47B 81/005
9,241,566 B1 * 1/2016 Chen ..... A47B 57/38
9,301,610 B1 * 4/2016 Berry ..... A47B 96/1416
9,713,379 B1 * 7/2017 Tsai ..... A47B 96/06
2002/0029529 A1 * 3/2002 Waalkes et al. ..... 52/36.1
2002/0153341 A1 * 10/2002 May ..... A47B 57/402 211/192
2003/0020387 A1 * 1/2003 Wing et al. ..... 312/408
2004/0055514 A1 * 3/2004 De Land et al. ..... 108/108
2004/0079719 A1 * 4/2004 Weaver ..... A47B 57/50 211/192
2005/0173359 A1 * 8/2005 Wagner et al. ..... 211/90.02
2005/0263465 A1 * 12/2005 Chung ..... 211/90.02
2006/0213849 A1 * 9/2006 Bienick ..... 211/90.02
2007/0241072 A1 * 10/2007 Bryant et al. ..... 211/90.02
2009/0058248 A1 * 3/2009 Gossens et al. ..... 312/408
2010/0193455 A1 * 8/2010 Russell et al. ..... 211/90.02
2010/0252521 A1 * 10/2010 Chen ..... 211/208
2013/0284865 A1 * 10/2013 Tewkesbury ..... 248/176.1
2017/0208947 A1 * 7/2017 Tsai ..... A47B 96/06

* cited by examiner

VERTICAL SHELF SUPPORT BARS HAVING LATERALLY SPACED APART FIRST SUPPORT INTERFACES AND SECOND SUPPORT INTERFACES RECESSED AND LATERALLY INSIDE THE FIRST SUPPORT INTERFACES

BACKGROUND OF THE INVENTION

The present invention relates vertical shelf supports and in particular to vertical shelf supports providing a first set of mounting features and a nested second set of mounting features.

Know vertical shelf supports include a single row of vertically spaced apart mounting features. There is often a desire to mount a panel to the vertical supports, and to mount shelves over the panels. Unfortunately, the known vertical shelf supports do not allow such configurations.

BRIEF SUMMARY OF THE INVENTION

The present invention addresses the above and other needs by providing a nested vertical shelf mount system which includes vertical bars having a first set of vertically spaced apart mounting features and a second set of vertically spaced apart mounting features spaced inside and recessed behind the first set of vertically spaced apart mounting features. The mounting features may be any feature allowing a shelf, panel, or the like, to be attached to the vertical bars. A panel may be attached to the second set of vertically spaced apart mounting features and a shelf may be attached to the first set of vertically spaced apart mounting features residing over the panel to provide a finished appearance In accordance with one aspect of the invention, there are provided vertical bars with a first set of vertically spaced apart mounting features and a second set of vertically spaced apart mounting features spaced inside and recessed behind the first set of vertically spaced apart mounting features. The vertical bars may include identical sets of mounting features or different mounting features. The mounting features may be narrow rectangular slots for accepting hooks, or may be "T" slots wide at the top and narrowing towards the bottom to accept buttons. Slightly wider shelve and panels may be mounted to the first set of vertically spaced apart mounting features and slightly narrower shelve and panels may be mounted to the second set of vertically spaced apart mounting features.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
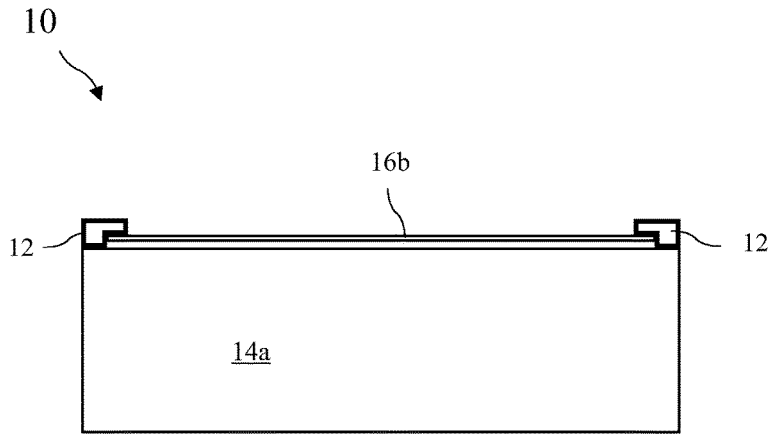
FIG. 1B is a top view of the nested vertical shelf mount system according to the present invention.
Figure 1A:
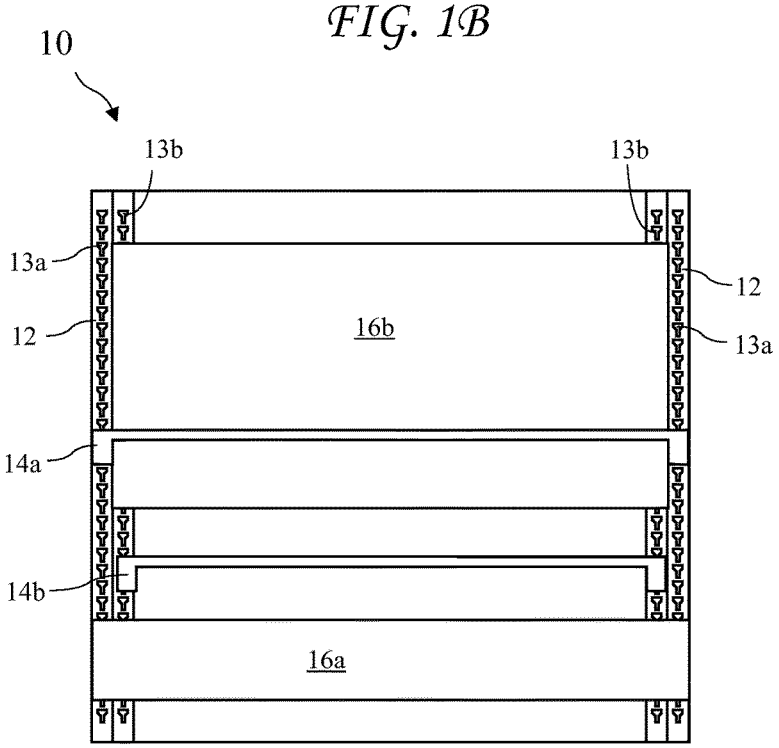
FIG. 1A is a front view of a nested vertical shelf mount system according to the present invention.
Figure 1C:
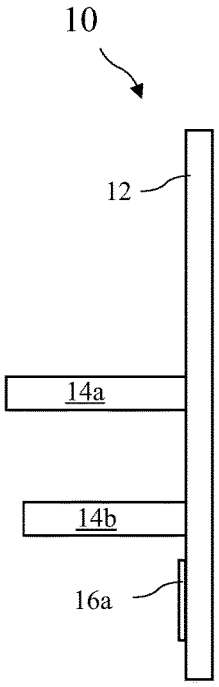
FIG. 1C is a side view of the nested vertical shelf mount system according to the present invention.

A front view of a nested vertical shelf mount system 10 according to the present invention is shown in FIG. 1A, a front view of the nested vertical shelf mount system 10 is shown in FIG. 1B, and a side view of the nested vertical shelf mount system 10 is shown in FIG. 1C. As can be seen in FIG. 1A, there is a first distance, defined by the distance between features 13*a* of adjacent vertical bars 12, and a second distance, defined by the distance between features 13*b* of adjacent vertical bars 12, and the first distance is greater than the second distance. The nested vertical shelf mount system 10 includes two vertical bars 12, and a combination of wider and narrower shelves 14*a* and 14*b* respectively, and a combination of wider and narrower panels 16*a* and 16*b* respectively. The wider shelves 14*a* and panels 16*a* attached to features 13*a* on the vertical bars 12, and the narrower shelves 14*b* and panels 16*b* attached to features 13*b* on the vertical bars 12.

Figure 2D:
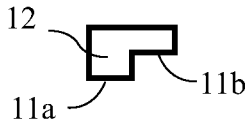
FIG. 2D is a top view of the vertical bar of the nested vertical shelf mount system according to the present invention.
Figure 2B:
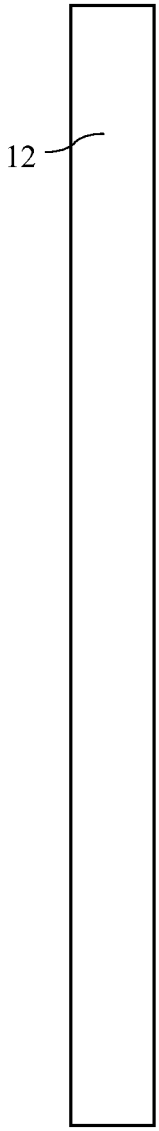
FIG. 2B is a left side view of the vertical bar of the nested vertical shelf mount system according to the present invention.
Figure 2A:
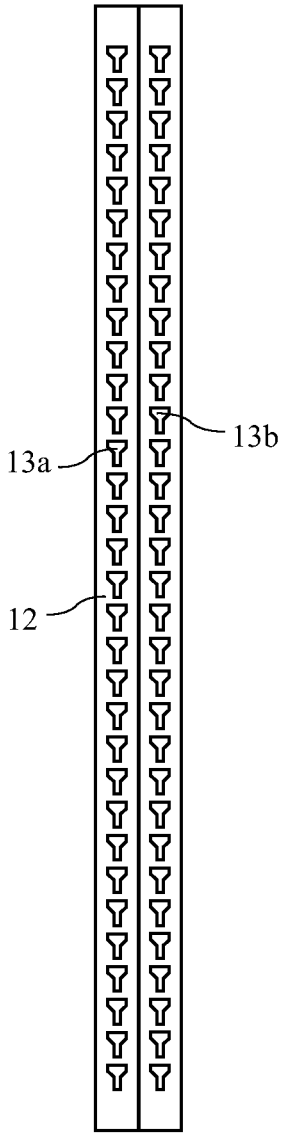
FIG. 2A is a front view of a vertical bar of the nested vertical shelf mount system according to the present invention.
Figure 2C:
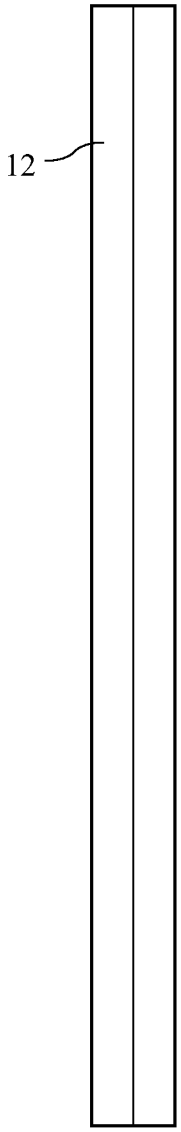
FIG. 2C is a right side view of the vertical bar of the nested vertical shelf mount system according to the present invention.

A front view of the vertical bar 12 is shown in FIG. 2A, a left side view of the vertical bar 12 is shown in FIG. 2B, a right side view of the vertical bar 12 is shown in FIG. 2C, and a top view of the vertical bar 12 is shown in FIG. 2D. As can be seen in the embodiment shown in FIG. 2D, the cross-section of the vertical bar defines an "L" shape. The vertical bars 12 are similar to know vertical bars having the forward surface 11*a* having features 13*a*, but additionally include a recessed surface 11*b* having the features 13*b*. The features 13*a* and 13*b* may be identical features for different features. For example, they may be narrow rectangular slots for accepting hooks, or "T" slots wide at the top and narrowing towards the bottom to accept buttons 20 (see FIGS. 3A, 3C, and 3D).

Figure 3C:
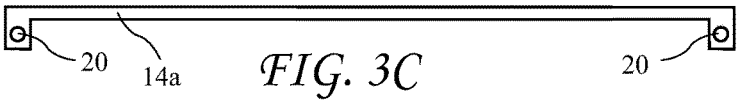
FIG. 3C is a rear view of the wider shelf of the nested vertical shelf mount system according to the present invention.
Figure 3A:
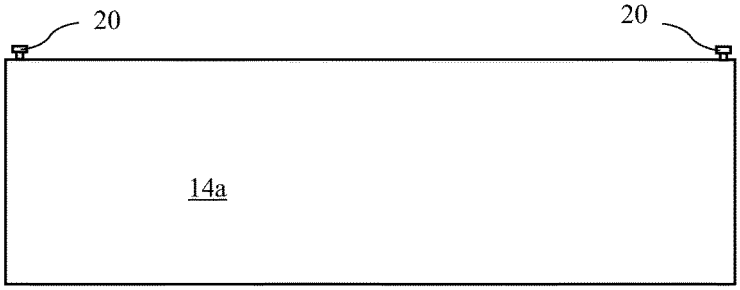
FIG. 3A is a top view of a wider shelf of the nested vertical shelf mount system according to the present invention.
Figure 3B:
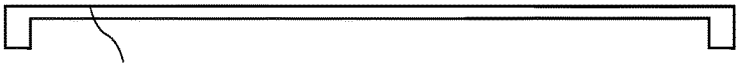
FIG. 3B is a front view of the wider shelf of the nested vertical shelf mount system according to the present invention.
Figure 3D:
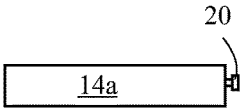
FIG. 3D is a side view of the wider shelf of the nested vertical shelf mount system according to the present invention.

A top view of the wider shelf 14*a* of the nested vertical shelf mount system 10 is shown in FIG. 3A, a front view of the wider shelf 14*a* of the nested vertical shelf mount system 10 is shown in FIG. 3B, a rear view of the wider shelf 14*a* of the nested vertical shelf mount system 10 is shown in FIG. 3C, and a side view of the wider shelf 14*a* of the nested vertical shelf mount system 10 is shown in FIG. 3D. The shelf 14*a* includes buttons 20 which engage the "T" slots 13*a* in the vertical bars 12. The narrower shelves 14*a* are nearly identical, but are narrower to engage the features 13*b* in the vertical bars 12.

Figure 4B:
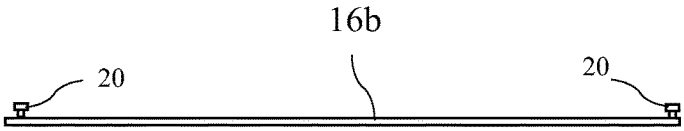
FIG. 4B is a top view of the narrower panel of the nested vertical shelf mount system according to the present invention.
Figure 4A:
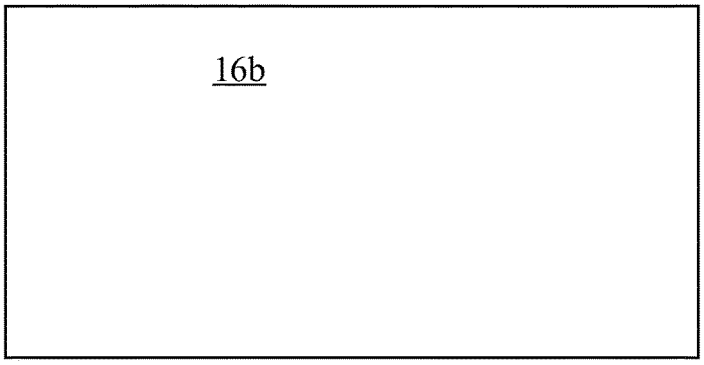
FIG. 4A is a front view of a narrower panel of the nested vertical shelf mount system according to the present invention.
Figure 4C:
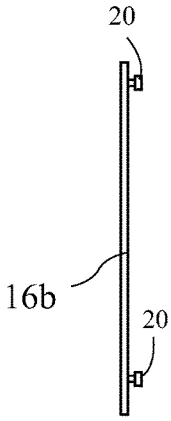
FIG. 4C is a side view of the narrower panel of the nested vertical shelf mount system according to the present invention.

A front view of the narrower panel 16*b* of the nested vertical shelf mount system 10 is shown in FIG. 4A, a top view of the narrower panel 16*b* of the nested vertical shelf mount system 10 is shown in FIG. 4B, and a side view of the narrower panel 16*b* of the nested vertical shelf mount system 10 is shown in FIG. 4A. The narrow panel 16*b* includes at least two buttons 20 for engaging the "T" slots 13*a* in the vertical bars 12, and preferably includes 4 buttons spaced vertically and horizontally apart for engaging the "T" slots 13*a* in the vertical bars 12. The narrower panel 16*b* is attached to the features 13*b* and may reside behind the shelf 14*a* providing a finished appearance.

Figure 5:
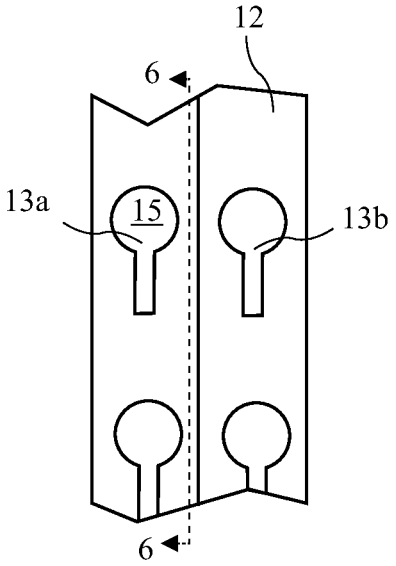
FIG. 5 shows features for attaching a button connector to the vertical bars according to the present invention.
Figure 6:
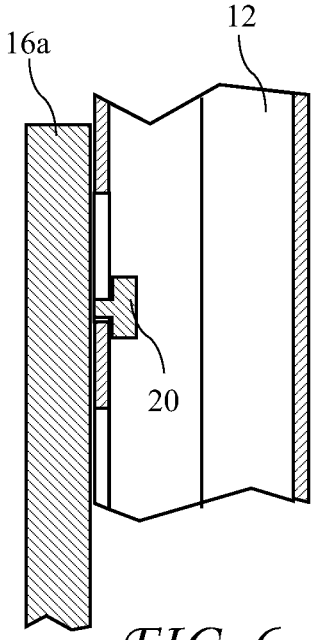
FIG. 6 show a cross-sectional view of the wider panel attached to the vertical bars using the button connector taken along line 6-6 of FIG. 5, according to the present invention.

A detailed view of the feature 13*a* and 13*b* for attaching a button connector 20 to the vertical bar is shown in FIG. 5 and a cross-sectional view of the wider panel 16*a* attached to the vertical bar 12 using the button connector 20 is shown in FIG. 6. The button connector 20 is inserted through the mouth 15 of the T" slot 13*a* and dropped into the T" slot 13*a*.

Figure 7:
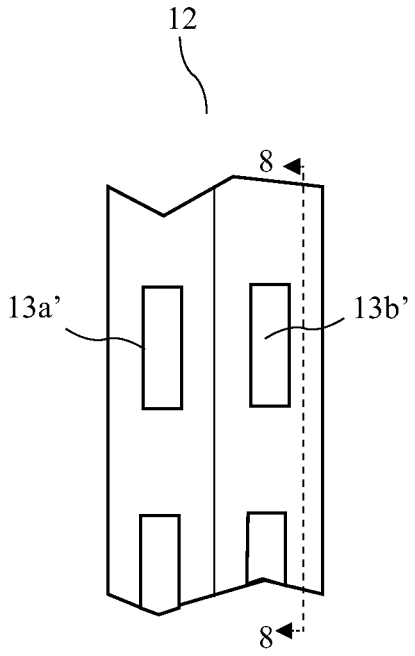
FIG. 7 shows features for attaching a hook connector to the vertical bars according to the present invention.
Figure 8:
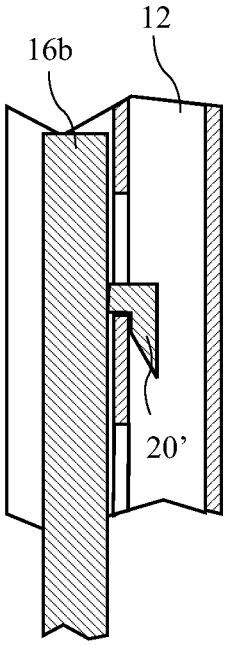
FIG. 8 show a cross-sectional view of the narrower panel attached to the vertical bars using the hook connector taken along line 8-8 of FIG. 7, according to the present invention.

A detailed view of the features for attaching a hook connector 20' to the vertical bars 12 is shown in FIG. 7 and a cross-sectional view of the narrower panel 16*b* attached to the vertical bars 12 using the hook connector 20' is shown in FIG. 8. The hook connector 20*i* is inserted through the rectangular slot 13*a'* and dropped into the rectangular slot 13*a'*.

While the invention herein disclosed has been described by means of specific embodiments and applications thereof, numerous modifications and variations could be made thereto by those skilled in the art without departing from the scope of the invention set forth in the claims.

We claim:

1. A shelving system comprising:

at least two vertical bars, each vertical bar comprising:

a front forward facing surface having a plurality of first slots therein; and a recessed forward facing surface located behind and laterally offset from the front forward facing surface, the recessed forward facing surface having a plurality of second slots therein;

wherein each vertical bar has a cross section that is L-shaped;

at least one of a wider shelf or a wider panel, each wider shelf and each wider panel comprises a first width and a pair of laterally spaced apart wide connectors, wherein each pair of laterally spaced apart wide connectors are inserted within a corresponding pair of first slots from said plurality of first slots in two corresponding vertical bars from said at least two vertical bars; and at least one of a narrower shelf or a narrower panel, each narrower shelf and each narrower panel comprises a second width and a pair of laterally spaced apart narrow connectors, wherein each pair of laterally spaced apart narrow connectors are inserted within a corresponding pair of second slots from said plurality of second slots in said two corresponding vertical bars from said at least two vertical bars;

wherein the first width is larger than the second width;

wherein a first distance between each corresponding pair of first slots from said plurality of first slots in said two corresponding vertical bars from said at least two vertical bars is greater than a second distance between each corresponding pair of second slots from said plurality of second slots in said two corresponding vertical bars from said at least two vertical bars;

wherein each narrower panel is configured to be nested between two corresponding front forward facing surfaces from said two corresponding vertical bars from said at least two vertical bars.

2. The shelving system of claim 1, wherein the at least one of a wider shelf or a wider panel comprises a wider shelf.

3. The shelving system of claim 1, wherein the at least one of a narrower shelf or a narrower panel comprises a narrower panel.

4. The shelving system of claim 1, wherein: the at least one of a narrower shelf or a narrower panel comprises a narrower panel;

wherein the at least one of a wider shelf or a wider panel comprises a wider shelf, and the wider shelf covers a portion of the narrower panel.

5. The shelving system of claim 1, wherein the at least one of a wider shelf or a wider panel comprises a wider panel.

6. A shelving system comprising:

at least two laterally spaced apart vertical bars, each vertical bar comprising:

a first forward facing surface comprising a plurality of first slots; and a second forward facing surface located behind and laterally offset from the first forward facing surface, the second forward facing surface comprises a plurality of second slots;

wherein each vertical bar has a cross section that is L-shaped;

a shelf having a first width and a pair of laterally spaced apart first connectors;

wherein the pair of laterally spaced apart first connectors are inserted within a corresponding pair of first slots from said plurality of first slots in two corresponding vertical bars from said at least two laterally spaced apart vertical bars; and a panel having a second width and laterally spaced apart second connectors;

wherein the pair of laterally spaced apart second connectors are inserted within a corresponding pair of second slots from said plurality of second slots in said two corresponding vertical bars from said at least two laterally spaced apart vertical bars;

wherein the first width is larger than the second width;

and at least a portion of the panel resides behind the shelf;

wherein a first distance between each corresponding pair of first slots from said plurality of first slots in said two corresponding vertical bars from said at least two laterally spaced apart vertical bars is greater than a second distance between each corresponding pair of second slots from said plurality of second slots in said two corresponding vertical bars from said at least two laterally spaced apart vertical bars;

wherein the panel is configured to be nested between two corresponding first forward facing surfaces from said two corresponding vertical bars from said at least two laterally spaced apart vertical bars.

7. A shelving system comprising:

a first vertical bar comprising:

a first vertical bar first forward facing surface comprising a plurality of first slots therein; and a first vertical bar second forward facing surface located behind and laterally off set from the first vertical bar first forward facing surface, the first vertical bar second forward facing surface comprises a plurality of second slots therein;

a second vertical bar comprising:

a second vertical bar first forward facing surface comprising a plurality of third slots therein; and a second vertical bar second forward facing surface located behind and laterally off set from the second vertical bar first forward facing surface, the second vertical bar second forward facing surface comprises a plurality of fourth slots therein;

wherein the first vertical bar and the second vertical bar each has a cross section that is L-shaped; and a shelf having a first width and a pair of laterally spaced apart shelf connectors;

wherein a first shelf connector from said pair of shelf connectors is inserted within a corresponding first slot from said plurality of first slots and a second shelf connector from said pair of shelf connectors is inserted within a corresponding third slot from said plurality of third slots in order to mount the shelf between the first vertical bar first forward facing surface and the second vertical bar first forward facing surface;

a panel comprising a second width and a pair of panel connectors; wherein a first panel connector from said pair of panel connectors is inserted within a corresponding second slot from said plurality of second slots and a second panel connector from said pair of panel connectors is inserted within a corresponding fourth slot from said plurality of fourth slots in order to mount the panel between the first vertical bar second forward facing surface and the second vertical bar second forward facing surface;

wherein the first width is larger than the second width;

and at least a portion of the panel resides behind the shelf;

wherein a first distance between a corresponding pair of first slots and third slots from said plurality of first slots and said plurality of third slots is greater than a second distance between a corresponding pair of second slots and fourth slots from said plurality of second slots and said plurality of fourth slots;

wherein the panel is configured to be nested between the first vertical bar first forward facing surface and the second vertical bar first forward facing surface.

* * * * *